US006099351A

United States Patent [19]

Wu

[11] Patent Number: 6,099,351

[45] Date of Patent: Aug. 8, 2000

[54] SHIELDED ELECTRICAL CONNECTOR HAVING A SPACER WITH IMPROVED LOCKING MEANS FOR ENGAGEMENT WITHIN THE CONNECTOR

[75] Inventor: Kun-Tsan Wu, Tu-Chen, Taiwan

[73] Assignee: Hon Hai Precision Ind. Co., Ltd., Tqapei Hsien, Taiwan

[21] Appl. No.: 09/300,089

[22] Filed: Apr. 26, 1999

[30] Foreign Application Priority Data

Dec. 31, 1998 [TW] Taiwan ..... 87222048

[51] Int. Cl.[7] ..... H01R 13/648; H01R 13/66

[52] U.S. Cl. ..... 439/607; 439/541.5

[58] Field of Search ..... 439/541.5, 527, 439/540.1, 607, 608, 609, 610, 95, 108

[56] References Cited

U.S. PATENT DOCUMENTS 5,637,015 6/1997 Tan et al. ..... 439/607
5,863,222 1/1999 Kinsey et al. ..... 439/607

*Primary Examiner*—Lincoln Donovan
*Assistant Examiner*—Chandrika Prasad
*Attorney, Agent, or Firm*—Wei Te Chung

[57] ABSTRACT

An electrical connector assembly comprises a housing, a number of contacts, a spacer for retaining the contacts, and a pair of first grounding shields and a second grounding shield coupled together across the housing. The spacer is secured in a rear portion of the housing with a pair of recessed portions thereof and wedges on the recessed portions tightly engaging with upper and lower blocks of the housing. The second grounding shield couples with the first grounding shields via the housing by projections and openings thereof engagement with cutouts and outwardly stamped tabs of the first grounding shields.

15 Claims, 4 Drawing Sheets

10

SHIELDED ELECTRICAL CONNECTOR HAVING A SPACER WITH IMPROVED LOCKING MEANS FOR ENGAGEMENT WITHIN THE CONNECTOR

BACKGROUND OF THE INVENTION

The present invention relates to an electrical connector assembly, and particularly to a stacked electrical connector assembly having at least two ports for mating with other electrical devices.

Some electrical devices of a computer, such as a power connector, are frequently inserted into or withdrawn from other electrical devices thereby creating a frictional force between the electrical devices which may damage or displace elements of the electrical devices. Thus, the secure assembly of elements within an electrical device is the objective of designers in the computer field.

Taiwan Patent Application Nos. 84104611, 85220031, 86204491 and 86212164 each disclose an electrical connector having a spacer assembled in a housing. The spacer has a plurality of contact receiving cavities for extension of contacts of the connector therethrough thereby equidistantly spacing the contacts from each other. However, the spacer can not be expediently and securely assembled to the housing. Furthermore, the spacer of a stacked electrical connector having a plurality of long contacts and a plurality of short contacts is more difficult to assemble to the housing. Hence, an improved electrical connector is required to overcome the disadvantages of the prior art.

BRIEF SUMMARY OF THE INVENTION

A first object of the present invention is to provide a stacked electrical connector assembly having a spacer that can be expediently and securely assembled to a housing thereof.

A second object of the present invention is to provide a stacked electrical connector assembly having grounding shields that can be assembled to the housing expediently and securely.

Accordingly, an electrical connector assembly comprises a housing having a mating face and an engaging face, a plurality of contacts, a spacer for retaining the contacts and a pair of first grounding shields and a second grounding shield coupled together across the housing.

The housing defines a pair of ridges rearward extending from the engaging face thereof. Each ridge defines a pair of blocks in upper and lower positions of an inner face thereof. The spacer defines a pair of recessed portions at opposite sides thereof and a wedge on each recessed portion.

A rear section of each first grounding shield defines a pair of cutouts at a top face thereof and a pair of tabs respectively stamped inwardly and outwardly from each side thereof. The second grounding shield forms a pair of side plates and a top plate which respectively define a pair of openings and a pair of projections corresponding to the outwardly stamped tabs and the cutouts of the first grounding shield.

The spacer is secured in the housing with the recessed portions and the wedges thereof tightly engaging with the lower blocks of the housing. The second grounding shield couples with the first grounding shields through the housing by the projections and openings thereof engaging with the cutouts and the outwardly stamped tabs of the first grounding shields.

Other objects, advantages and novel features of the invention will become more apparent from the following detailed description of the present embodiment when taken in conjunction with the accompanying drawings.

DETAILED DESCRIPTION OF THE INVENTION

Figure 1:
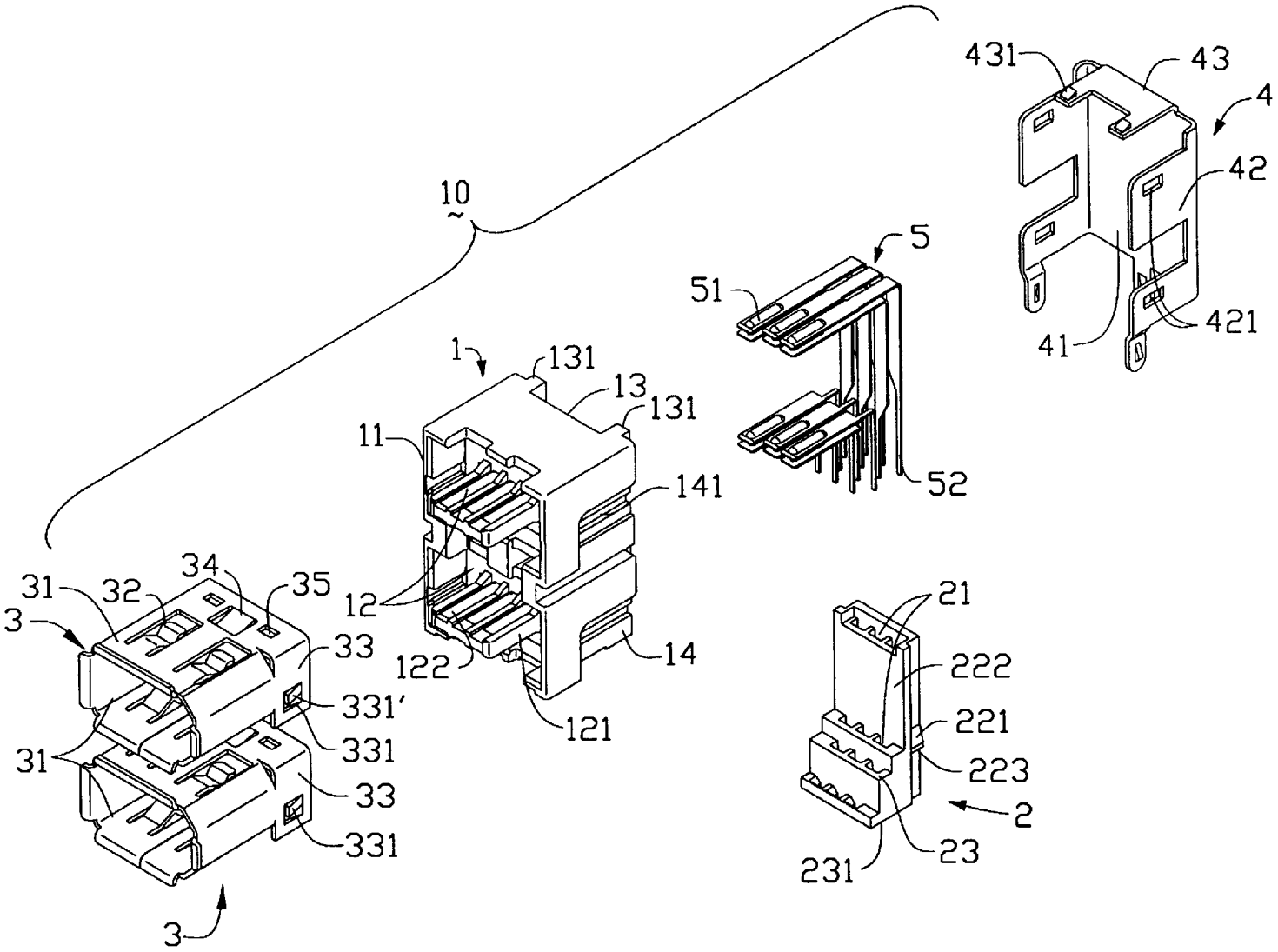
FIG. 1 is an exploded view of an electrical connector assembly of the present invention.
Figure 2:
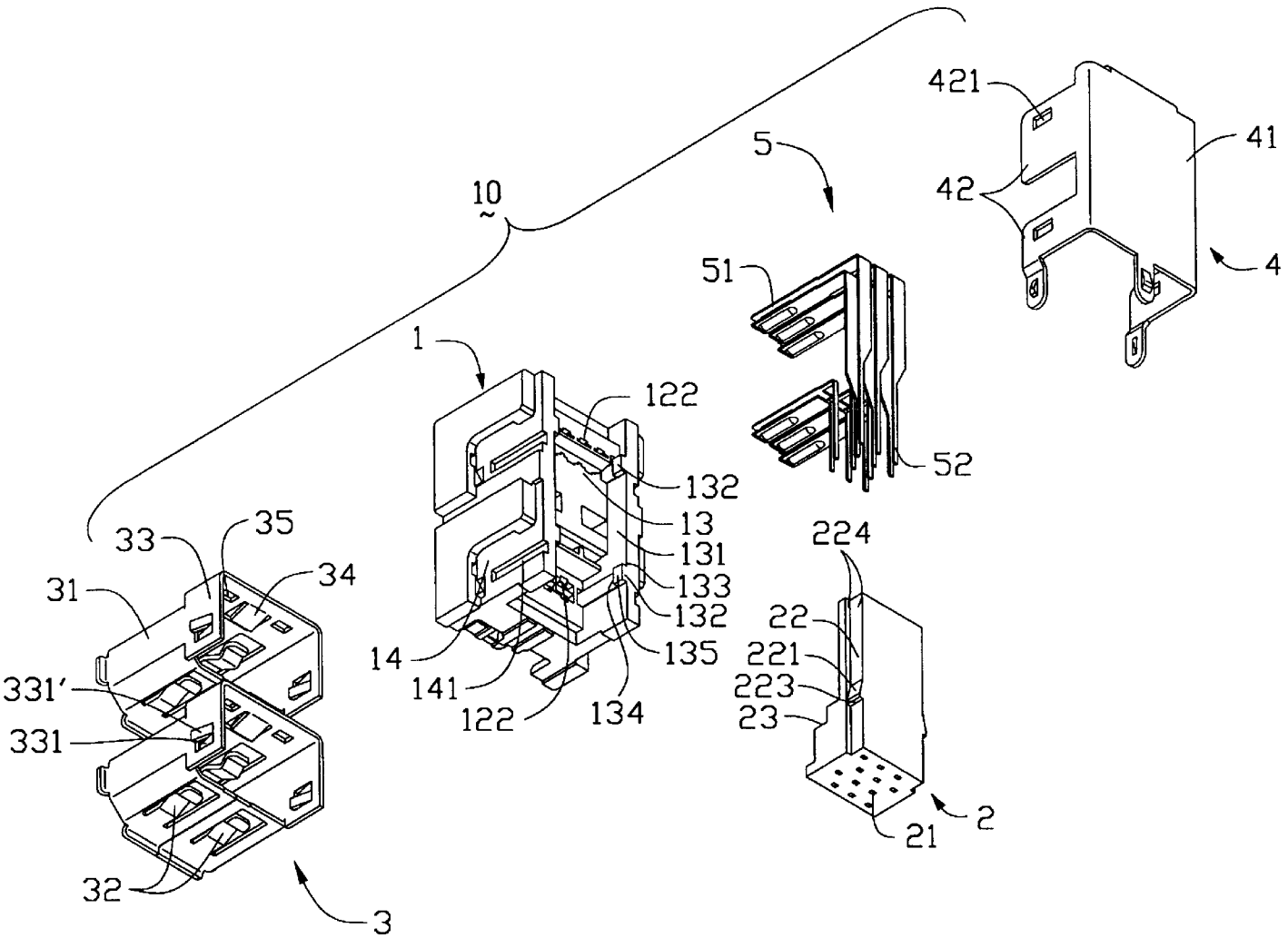
FIG. 2 is a view similar to FIG. 1 taken from a different perspective.

Referring to FIGS. 1 and 2, an electrical connector assembly 10 of the present invention comprises a housing 1, a spacer 2, a pair of first grounding/EMI shields 3, a second grounding/EMI shield 4 and a plurality of electrical contacts 5. The housing 1 forms two vertically aligned ports 12 in a mating face 11 thereof for mating with other electrical devices (not shown). A platform 121 is formed in a middle portion of each port 12. Contact receiving channels 122 are formed in opposite sides of the platform 121 and extend from the mating face 11 to an engaging face 13 for securely retaining the contacts 5. A pair of sidewalls 14 of the housing 1 each provides a ridge 131 rearward extending beyond the engaging face 13. A pair of blocks 132 is defined on upper and lower positions of an inner face of each ridge 131. Each block 132 of the corresponding pair defines an upper face 133, an inside face 134 opposing the engaging face 13 of the housing 1 and a side face 135 opposing the other block 132. Each sidewall 14 forms a pair of slit portions 141 in an outer surface thereof.

Each contact 5 has a mating portion 51 and a mounting portion 52 at opposite ends thereof. The contact 5 is bent approximately 90 degrees for being securely retained in the housing 1 and the spacer 2. The spacer 2 forms several steps 23 having different heights from a bottom surface thereof. A number of cavities 21 are defined through the steps 23 for receiving the mounting portions 52 of the contacts 5. The spacer 2 forms a pair of recessed portions 22 in opposite sides thereof. A pair of wedges 221 having a relatively broad bottom face 223 is provided at predetermined positions of the recessed portions 22 for securely engaging with the lower blocks 132 of the housing 1.

Each first grounding/EMI shield 3 is manufactured by a stamping process and forms a front section 31 and a rear section 33. The front section 31 forms several spring clips 32 in upper and lower faces thereof. The rear section 33 forms a latch 34 in a middle position of a top face thereof and a pair of cutouts 35 at opposite sides of the latch 34. The rear section 33 forms a pair of tabs 331, 331' respectively stamped inwardly and outwardly from each side thereof.

The second grounding/EMI shield 4 is manufactured by a stamping process and forms a rear shield face 41, a pair of side plates 42 and a top plate 43 extend from edges of the rear shield face 41. Each side plate 42 forms a pair of openings 421 corresponding to the outwardly stamped tabs 331' of the first grounding/EMI shield 3. The top plate 43 forms a pair of projections 431 corresponding to the cutouts 35 of the first grounding/EMI shield 3.

Figure 3:
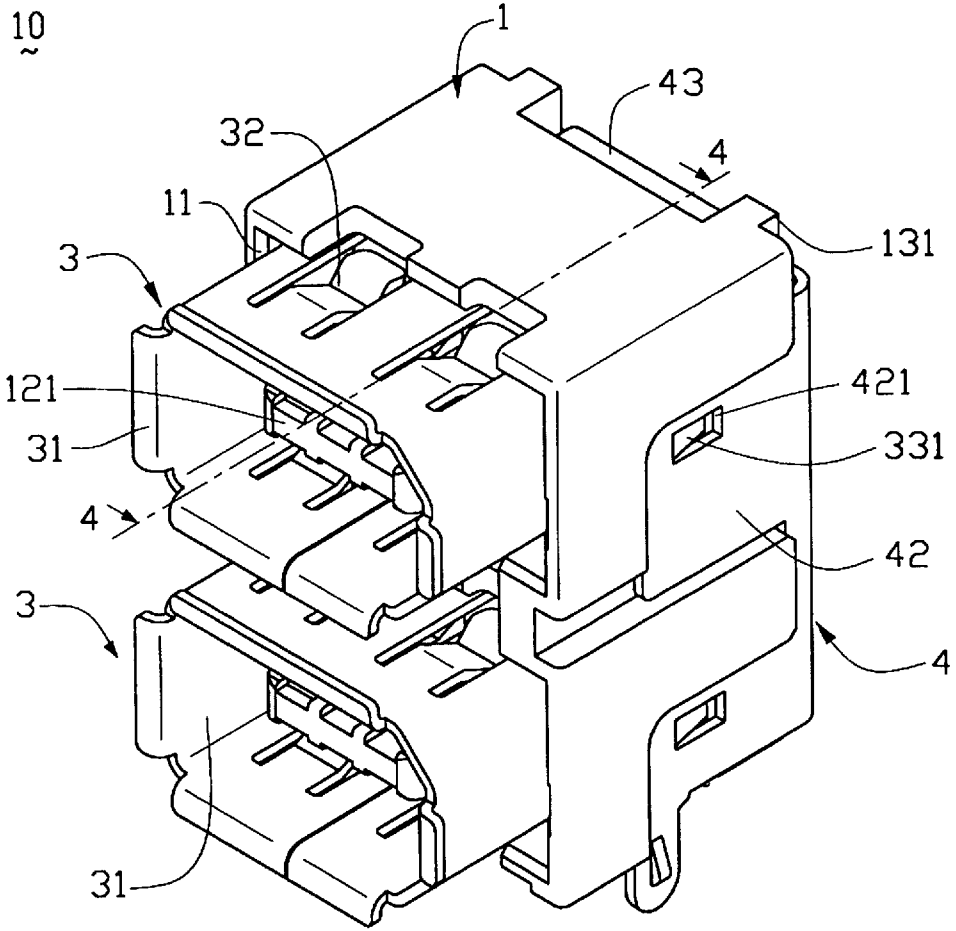
FIG. 3 is an assembled view of FIG. 1.
Figure 4:
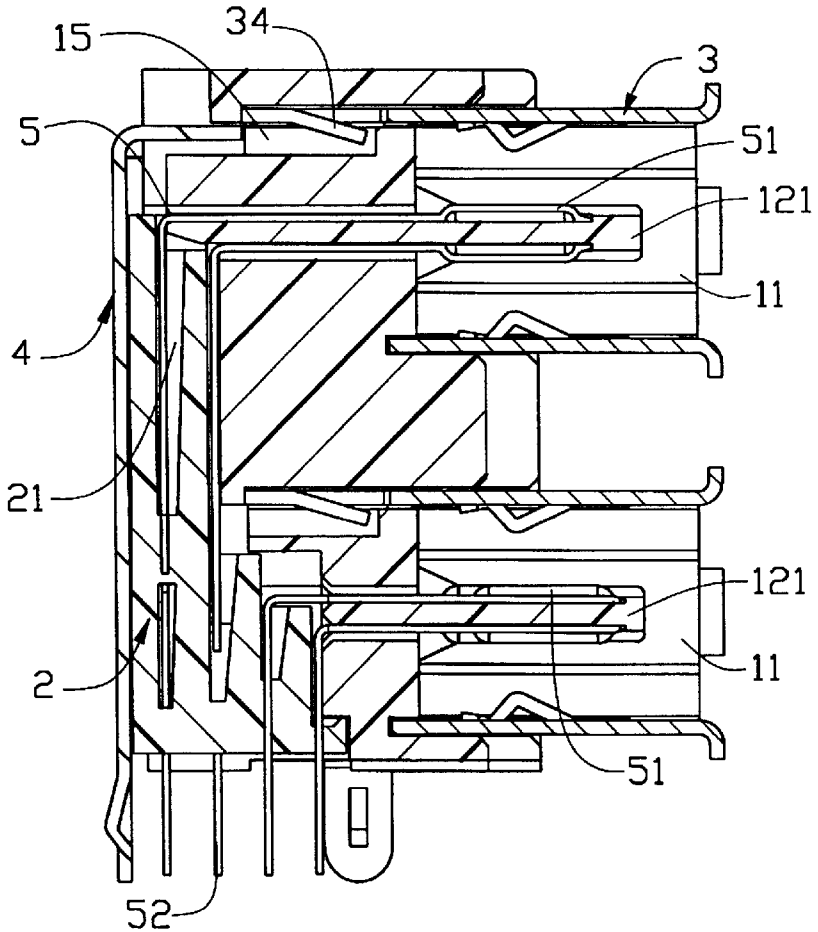
FIG. 4 is a cross sectional view of the electrical connector assembly taken along line 4—4 of FIG. 3.

Also referring to FIGS. 3 and 4, the contacts 5 are assembled into the housing 1 from the engaging face 13 and the mating portions 51 are received in the corresponding contact receiving channels 122. The spacer 2 is slide into the housing 1 along the inside faces 134 of the upper and lower blocks 132 and the engaging face 13 of the housing 1 from a bottom face of the housing 1 and is received between the ridges 131 whereby the mounting portions 52 of the contacts 5 are received in the cavities 21. The upper face 133 of the lower block 132 tightly abuts against the bottom face 223 of the wedge 221 and the inside face 134 and the side face 135 securely bear against recessed faces 224 of the recessed portion 22 of the spacer 2. The first grounding/EMI shields 3 are assembled into the corresponding ports 12 of the housing 1 from the mating face 11 whereby the latch 34 engages with a groove 15 defined in the housing 1 and the inwardly stamped tabs 331 engaging with the slit portions 141 (FIG. 2). The second grounding/EMI shield 4 engages with the first grounding shield 3 across the housing 1 with openings 421 and projections 431 thereof respectively coupling with the corresponding outwardly stamped tabs 331' and cutouts 35 of the first grounding/EMI shield 3.

It should be noted that because the first shields 3 are generally embedded within the housing 1 and do not extend out of the contour thereof laterally, thus assuring hidden interlocking arrangements between the first shields 3 and the second shield 4, and between the first shields 3 and the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a housing having a mating face, an engaging face opposite the mating face, a pair of stacked ports defined in the mating face, a plurality of contact receiving channels defined in each port, a pair of ridges rearward extending beyond the engaging face, and a pair of blocks formed on upper and lower positions of an inner face of each ridge;

a plurality of contacts received in the contact receiving channels, each contact including a mating portion and a mounting portion;

a spacer having a plurality of cavities for receiving the mounting portions of the contacts, the spacer forming a pair of recessed portions at opposite sides thereof and an engaging structure on each recessed portion, the spacer being received between the ridges with the recessed portions receiving the upper and lower blocks of the ridges and the engaging structure situated above the lower block, thereby preventing a rearward and a downward movement of the spacer with respect to the housing; and a pair of grounding shields received in corresponding ports of the housing.

2. The electrical connector assembly as claimed in claim 1, wherein the engaging structure comprises a wedge abutting against an upper face of the lower block.

3. The electrical connector assembly as claimed in claim 1, wherein the upper and lower blocks each defines an inside face opposing the engaging face of the housing and a side face opposing the other block, the inside face and the side face securely bear against recessed faces of the recessed portion of the spacer.

4. The electrical connector assembly as claimed in claim 3, wherein, in assembly, the spacer is slid into the housing along the inside faces of the upper and lower blocks and the engaging face of the housing from a bottom face of the housing.

5. The electrical connector assembly as claimed in claim 1, wherein each grounding shield forms a pair of tabs respectively stamped inwardly and outwardly from each side thereof.

6. The electrical connector assembly as claimed in claim 5, wherein the housing forms a pair of slit portions in an outer surface of each sidewall thereof, the inwardly stamped tabs of the grounding shield engage with the corresponding slit portions.

7. The electrical connector assembly as claimed in claim 5, wherein each grounding shield forms a pair of cutouts in a top face of a rear section thereof.

8. The electrical connector assembly as claimed in claim 7, further comprising a second grounding shield, and wherein the second grounding shield comprises a pair of side plates and a top plate, each side plate forming a pair of openings, the top plate forming a pair of projections, and the second grounding shield engages with the grounding shield across the housing with openings and projections thereof respectively coupling with corresponding outwardly stamped tabs and cutouts of the grounding shield.

9. An electrical connector assembly comprising:

a housing defining a mating face and an engaging face opposite to said mating face, at least one port defined on the mating face;

a plurality of contacts received within the housing;

a hose-type first shield inserted into the port of the mating face in a front-to-back direction; and a second shield positioned around the engaging face; wherein said second shield is fastened to the first shield in position so that both the first shield and the second shield are generally inside a cross-sectional boundary of the housing.

10. The connector assembly as claimed in claim 9, wherein the first shield is attached to the housing.

11. The connector assembly as claimed in claim 9, wherein a spacer aligning the contacts, is positioned between the housing and the second shield.

12. An electrical connector assembly comprising:

a housing defining a mating face and an engaging face opposite to said mating face, two ports defined on the mating face;

a plurality of contacts positioned within each of said two ports of the housing;

two separate first shields respectively inserted into the corresponding ports of the mating face in a front-to-back direction;

a second shield positioned around the engaging face; wherein both said two first shields are respectively and independently fastened to said second shield in position.

13. The electrical connector assembly as claimed in claim 12, wherein said two first shields are respectively fastened to the housing.

14. The electrical connector assembly as claimed in claim 12, wherein a spacer is attached to a rear portion of the housing between said second shield and the housing for alignment of the contacts.

15. The electrical connector assembly as claimed in claim 1, wherein the spacer is stair-like, forming several steps having different heights from a bottom surface of the spacer.

* * * * *